US006345525B1

(12) United States Patent
Bruyas et al.

(10) Patent No.: US 6,345,525 B1
(45) Date of Patent: Feb. 12, 2002

(54) TUBE BENDING MACHINE, MAGAZINE DEVICE THEREOF, AND METHOD FOR LOADING

(75) Inventors: Jean-Paul Bruyas, Lyons; Serge Cappello, Taluyers; Jean-Paul Chastan, Ecully, all of (FR)

(73) Assignee: Silfax Sarl, Vourles (FR)

( * ) Notice: Subject to any disclaimer, the term of this patent is extended or adjusted under 35 U.S.C. 154(b) by 0 days.

(21) Appl. No.: 09/589,596

(22) PCT Filed: Dec. 3, 1998

(86) PCT No.: PCT/FR98/02606

§ 371 Date: Jun. 9, 1999

§ 102(e) Date: Jun. 9, 1999

(87) PCT Pub. No.: WO99/38626

PCT Pub. Date: Aug. 5, 1999

(30) Foreign Application Priority Data

Jan. 30, 1998 (FR) ..... 98 01315

(51) Int. Cl.[7] ..... B21D 7/04

(52) U.S. Cl. ..... 72/307; 72/157

(58) Field of Search ..... 72/157, 158, 149, 72/307, 217, 388, 422, 424

(56) References Cited

U.S. PATENT DOCUMENTS

| | | | | | |
|---|---|---|---|---|---|
| 3,431,759 | A | * | 3/1969 | Kidera | 72/422 |
| 4,038,853 | A | * | 8/1977 | Schwarze | 72/157 |
| 4,495,788 | A | | 1/1985 | Traub | 72/157 |
| 4,567,745 | A | | 2/1986 | Schwarze | 72/157 |
| 4,888,971 | A | * | 12/1989 | Schwarze | 72/157 |
| 5,689,988 | A | | 11/1997 | Schwarze | 72/157 |

FOREIGN PATENT DOCUMENTS

| | | | | |
|---|---|---|---|---|
| DE | 25279 | * | 1/1956 | 72/157 |
| EP | 0120336 | | 10/1984 | |
| EP | 0759332 | | 2/1997 | |
| FR | 2530980 | | 2/1984 | |
| GB | 2187666 | | 9/1987 | |

OTHER PUBLICATIONS

International Preliminary Examination Report PCT/IPEA/409 conducted in International Application No. PCT/FR98/02606.

* cited by examiner

*Primary Examiner*—Daniel C. Crane
(74) *Attorney, Agent, or Firm*—Greenblum & Bernstein, P.L.C.

(57) ABSTRACT

Tube bending machine including an elongate fixed frame secured at one of its ends to a bending head and to a bending arm pivoting about the bending head, a magazine device on the bending arm, the magazine device bearing pairs of clamping jaws with different impressions formed thereon, and being pivotable at the same time as the bending arm about the bending head so as to shape tubes. The magazine device is moveable both, rotationally about its own longitudinal axis and in directions lying in planes which are at least one of, perpendicular and parallel to a plane containing the longitudinal axis of the fixed frame. The magazine device includes a magazine, a jaw support sliding along the bending arm, a magazine holder secured to the jaw support, a first motor for moving the magazine vertically on the magazine holder, and a second motor for rotating the magazine about its own longitudinal axis. The method for loading a pair of clamping jaws includes positioning a magazine device in a raised position on a magazine holder using a first motor, pivoting a magazine about its longitudinal axis using a second motor in order to select a pair of clamping jaws according to an impression formed on the jaws which corresponds to an exterior profile of a tube before the tube is bent, lowering the magazine device so that the clamping jaws index simultaneously and respectively, moving the bending head and the jaw support horizontally toward the tube so as to bring the clamping jaws of a corresponding pair of clamping jaws up against the tube, and bending the tube by pivoting the bending arm and the magazine device about the bending head and the bending roller.

17 Claims, 10 Drawing Sheets

TUBE BENDING MACHINE, MAGAZINE DEVICE THEREOF, AND METHOD FOR LOADING

BACKGROUND OF THE INVENTION

1. Field of the Invention

The present invention relates to a tube bending machine and to a magazine device for changing the pairs of clamping jaws on a tube bending machine and to a method for loading a pair of clamping jaws.

2. Discussion of Background Information

FR 2 530 980 discloses a tube bending machine which comprises an elongate frame on which there is disposed a moveable carriage secured to a rotary chuck. This rotary chuck grips a pipe which is to be advanced and rotated to preselected positions with respect to tools carried by a bending head.

For one bending operation, the carriage advances the pipe and the chuck rotates the pipe to position it with respect to the tools. In this type of machine, the press tool may press the rear part of the pipe against the bending tool or against another backing tool or a cam.

The gripping and bending tools collaborate to grip a front part of the pipe, and are simultaneously rotated about an approximately vertical axis. This causes the pipe to be curved about the bending tool. Thereafter, the tools are retracted, the carriage is advanced and the chuck is rotated in order to position the pipe suitably both in terms of longitudinal and in terms of rotational position, ready for the next bending operation.

The bending head, as a whole comprises a fixed arm assembly in which the mechanism for rotating the bending tool is mounted. The mechanism for operating the press tool is also mounted on the stationary arm. A swinging bending arm assembly is mounted on the fixed arm assembly so that it rotates as one with the bending tools about the axis thereof and this assembly carries the clamping tools and the mechanism for operating them.

The machine is preferably controlled entirely automatically so as to carry out a series of bending operations on a given pipe.

The bending tool is formed of a stack of coaxial bending tools with different curvatures. The machine can offer up any one of the bending tools or dies to the pipe, because the entire bending head is mounted so that it can move on the front end of the frame of the machine. Specifically, the bending head can move both ways, vertically and horizontally, in two directions which are perpendicular to one another, and directions perpendicular to the axis of the machine.

SUMMARY OF THE INVENTION

The bending machine and its magazine device according to the present invention are intended to bring pairs of clamping jaws with impressions of different shapes level with the bending head of the machine and to be able to select the one which corresponds to the exterior profile of the tube that is to be bent simply by rotating said magazine device about its longitudinal axis.

The tube bending machine according to the invention comprises, on the bending arm, a magazine device bearing pairs of clamping jaws with different impressions, said magazine device being able to pivot at the same time as the bending arm about the bending head so as to shape the tubes, while the magazine device can move both in terms of rotation about its own longitudinal axis and in directions lying in planes perpendicular and/or parallel to the plane containing the longitudinal axis of the fixed frame.

The tube bending machine according to the invention comprises a magazine device including a magazine holder secured to the jaw support sliding along the bending arm, of a magazine which can be moved vertically on the magazine holder by a motor and in terms of rotation about its own longitudinal axis using another motor, the magazine comprising at least one pair of clamping jaws on its periphery and two opposed jaws which collaborate respectively, with a bending roller of the bending head and with the jaw support of the bending arm.

The tube bending machine according to the invention comprises a magazine including a plate of square shape, each peripheral edge of which comprises an attachment device which allows the corresponding pairs of clamping jaws to slide.

The tube bending machine according to the invention comprises a magazine, the pairs of clamping jaws of which have an impression of different shape that complements the profile of the tube before it is bent.

The tube bending machine according to the invention includes a jaw support comprising, on a vertical edge, a slot which collaborates with an intermediate element secured either to one of the jaws of the corresponding pair of clamping jaws or to said jaw support.

The tube bending machine according to the invention comprises a bending head which moves in a horizontal direction lying in a plane perpendicular to the plane containing the longitudinal axis of the fixed frame.

The magazine device according to the invention comprises pairs of clamping jaws which have impressions of different shapes and movement means which, on the one hand, allow the magazine device to be pivoted about the bending head at the same time as the bending arm and, on the other hand, allow the magazine device to be moved in directions which lie in planes perpendicular and/or parallel to the plane containing the longitudinal axis of the fixed frame, while it comprises other movement means allowing the magazine device to be rotated about its own longitudinal axis.

The magazine device according to the invention comprises a magazine holder secured to the jaw support sliding along the bending arm, a magazine which can be moved both in vertical translation on the magazine holder via a motor and in terms of rotation about its own longitudinal axis using another motor, the magazine comprising on its periphery at least one pair of clamping jaws including two opposed jaws which collaborate respectively, one of them with a roller of the bending head and the other with the jaw support of the bending arm.

The magazine device according to the invention comprises a magazine which includes a plate of square shape, each peripheral edge of which comprises an attachment device which allows the corresponding pairs of clamping jaws to slide.

The magazine device according to the invention comprises pairs of clamping jaws which have impressions of different shapes that complement the profile of the tube before it is bent.

The magazine device according to the invention comprises a jaw support comprising, on a vertical edge, a slot which collaborates with an intermediate element secured either to one of the jaws of the corresponding pair of clamping jaws or to the jaw support.

The method for loading a pair of clamping jaws in order to operate the bending machine according to the present invention comprises in:

positioning the magazine device in a raised position on the magazine holder using the motor;

pivoting the magazine about its longitudinal axis using another motor in order to select the pair of clamping jaws according to the impression which corresponds to the profile of the tube before it is bent;

lowering the magazine device so that the jaws of the corresponding pair of clamping jaws index simultaneously and respectively, one of them on the bending roller of the bending head and the other on the jaw support of the bending arm;

moving the bending head and the jaw support horizontally toward the tube so as to bring the jaws of the corresponding pair of clamping jaws up against the tube;

bending the tube by pivoting the bending arm and the magazine device about the bending head and the bending roller.

According to the invention, a tube bending machine comprises an elongate fixed frame secured at one of its ends to a bending head and to a bending arm pivoting about the bending head. The machine comprises a magazine device on the bending arm, the magazine device bearing pairs of clamping jaws with different impressions formed thereon, and being pivotable at the same time as the bending arm about the bending head so as to shape tubes. The magazine device is moveable both, rotationally about its own longitudinal axis and in directions lying in planes which are at least one of, perpendicular and parallel to a plane containing the longitudinal axis of the fixed frame.

The magazine device comprises a magazine, a jaw support sliding along the bending arm, a magazine holder secured to the jaw support, a first motor for moving the magazine vertically on the magazine holder, a second motor for rotating the magazine about its own longitudinal axis, the magazine comprising at least one pair of clamping jaws on its periphery, the clamping jaws comprising two opposed jaws, a first of the two opposed jaws cooperating with a bending roller of the bending head, and a second of the opposed jaws cooperating with the jaw support of the bending arm.

According to a further aspect of the invention, the magazine comprises a plate, each peripheral edge of which comprises an attachment device which allows the corresponding pair of clamping jaws to slide. According to an embodiment of the invention, the plate is of square shape.

Further, according to the invention, each of the at least one pair of clamping jaws has an impression formed thereon, the impression complementing the exterior profile of the tube before it is bent.

Further yet, according to the invention, the jaw support comprises a slot on a vertical edge thereof, the slot cooperating with an intermediate element secured to one of the jaws of the corresponding pair of clamping jaws or to the jaw support. The bending head moves in a horizontal direction lying in a plane perpendicular to a plane containing a longitudinal axis of the fixed frame.

According to the invention, a magazine device of a tube bending machine includes a fixed frame secured at one of its ends to a bending head and to a bending arm pivoting about the bending head, and comprises at least one pair of clamping jaws which have impressions of different shapes formed thereon, a first movement mechanism which, on the one hand, allows the magazine device to be pivoted about the bending head at the same time as the bending arm and, on the other hand, allows the magazine device to be moved in directions which lie in planes which are at least one of perpendicular and parallel to the plane containing the longitudinal axis of the fixed frame and a second movement mechanism, which concurrently allows the magazine device to be rotated about its own longitudinal axis.

The magazine device further comprises a magazine holder secured to a jaw support sliding along the bending arm, a magazine, a first motor for moving the magazine in vertical translation on the magazine holder, a second motor for rotating the magazine about its own longitudinal axis, the magazine comprising on its periphery at least one pair of clamping jaws. The clamping jaws comprise two opposed jaws, a first of the opposed jaws cooperating with a bending roller of the bending head, and a second of the opposed jaws cooperating with the jaw support of the bending arm.

According to the invention, the jaw support comprises, on a vertical edge, a slot which cooperates with an intermediate element secured to one of the jaws of the at least one pair of clamping jaws. Alternatively, the intermediate element could be secured to the jaw support.

The invention further entails a method for loading a pair of clamping jaws in order to operate a tube bending machine which comprises an elongate fixed frame secured at one of its ends to a bending head and a bending arm pivoting about the bending head. The method comprises positioning a magazine device in a raised position on a magazine holder using a first motor, pivoting a magazine about its longitudinal axis using a second motor in order to select a pair of clamping jaws according to an impression formed on the jaws which corresponds to an exterior profile of a tube before the tube is bent, lowering the magazine device so that the clamping jaws index simultaneously and respectively, one of the clamping jaws on a bending roller of the bending head, and another of the clamping jaws, a jaw support of the bending arm, moving the bending head and the jaw support horizontally toward the tube so as to bring the clamping jaws of a corresponding pair of clamping jaws up against the tube, and bending the tube by pivoting the bending arm and the magazine device about the bending head and the bending roller.

According to another aspect of the invention, there is a novel method for loading a pair of clamping jaws in order to operate a tube bending machine, the tube bending machine including an elongate fixed frame secured at one of its ends to a bending head and to a bending arm pivoting about the bending head, a magazine device on the bending arm, the magazine device bearing pairs of clamping jaws with different impressions formed thereon, and being pivotable at the same time as the bending arm about the bending head so as to shape tubes, the magazine device being moveable both, rotationally about its own longitudinal axis and in directions lying in planes which are at least one of, perpendicular and parallel to a plane containing the longitudinal axis of the fixed frame, the magazine device including a magazine, a jaw support sliding along the bending arm, a magazine holder secured to the jaw support, a first motor for moving the magazine vertically on the magazine holder, a second motor for rotating the magazine about its own longitudinal axis, the magazine including at least one pair of clamping jaws on its periphery, the clamping jaws comprising two opposed jaws, a first of the two opposed jaws cooperating with a bending roller of the bending head, and a second of the opposed jaws cooperating with the jaw support of the bending arm, the method comprising positioning the magazine device in a raised position on the magazine holder using the first motor, pivoting the magazine about its longitudinal axis using the second motor in order to select the pair of clamping jaws according to the impression formed on the jaws which corresponds to the exterior profile of the tube before the tube is bent, lowering the magazine device so that the clamping jaws of the corresponding pair of clamping jaws index simultaneously and respectively, one of the clamping jaws on a bending roller of the bending head, and another of the clamping jaws, a jaw support of the bending arm, moving the bending head and the jaw support horizontally toward the tube so as to bring the clamping jaws of a corresponding pair of clamping jaws up against the tube, and bending the tube by pivoting the bending arm and the magazine device about the bending head and the bending roller.

According to yet another aspect of the invention, the tube bending machine comprises an elongate fixed frame secured at one of its ends to a bending head and to a bending arm pivoting about the bending head. The machine comprises a magazine device on the bending arm, the magazine device bearing pairs of clamping jaws with different impressions formed thereon, and being pivotable at the same time as the bending arm about the bending head so as to shape tubes. The magazine device is moveable both, rotationally about its own longitudinal axis and in directions lying in planes which are at least one of, perpendicular and parallel to a plane containing the longitudinal axis of the fixed frame. The magazine device includes a magazine, a jaw support sliding along the bending arm, a magazine holder secured to the jaw support, a first motor for moving the magazine vertically on the magazine holder, a second motor for rotating the magazine about its own longitudinal axis, the magazine comprising at least one pair of clamping jaws on its periphery, the clamping jaws comprising two opposed jaws, a first of the two opposed jaws cooperating with a bending roller of the bending head, and a second of the opposed jaws cooperating with the jaw support of the bending arm. The jaw support comprises a slot on a vertical edge thereof, the slot cooperating with an intermediate element secured to one of the jaws of the corresponding pair of clamping jaws or to the jaw support, the bending head moving in a horizontal direction lying in a plane perpendicular to a plane containing a longitudinal axis of the fixed frame before line 9, please add the following heading:

The description which is about to follow with reference to the appended drawings, given by way of nonlimiting examples, will allow better understanding of the invention, the features it offers and the advantages it is capable of affording:

DETAILED DESCRIPTION OF THE PRESENT INVENTION

Figure 1:
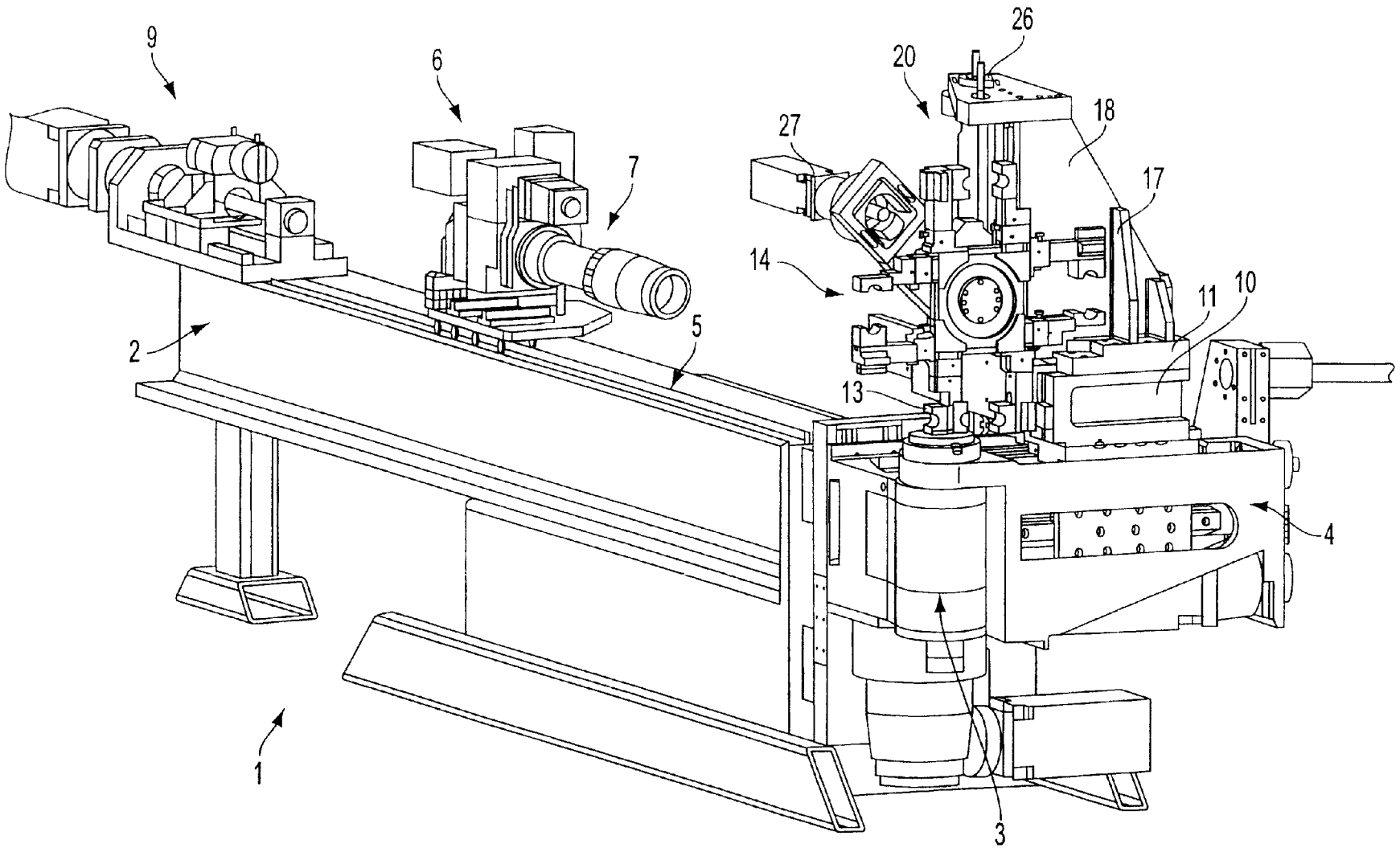
FIG. 1 is a view in perspective illustrating a machine for bending the tubes equipped with a magazine device according to the present invention.

FIG. 1 shows a bending machine 1 comprising a fixed frame 2 which at one of its ends bears a bending head 3 about which a bending arm 4 pivots.

The fixed frame 2 comprises, along its longitudinal axis, a guide rail 5 on which a carriage 6 slides toward and away from the bending head 3.

The carriage 6 comprises a chuck 7 for holding and guiding a tube 8 that is to be bent and which is moved in terms of translation and in terms of rotation about its axis. A device 9 also slides along the rail 5 so as, by means of an olive, to prevent the tube 8 from being crushed while it is being bent.

The bending arm 4 comprises a jaw support 10 which can be moved horizontally toward the bending head 3. The support 10 is secured to a vertical plate 11 extending over said support 10. The vertical plate is designed to carry a magazine device 12.

Figure 2:
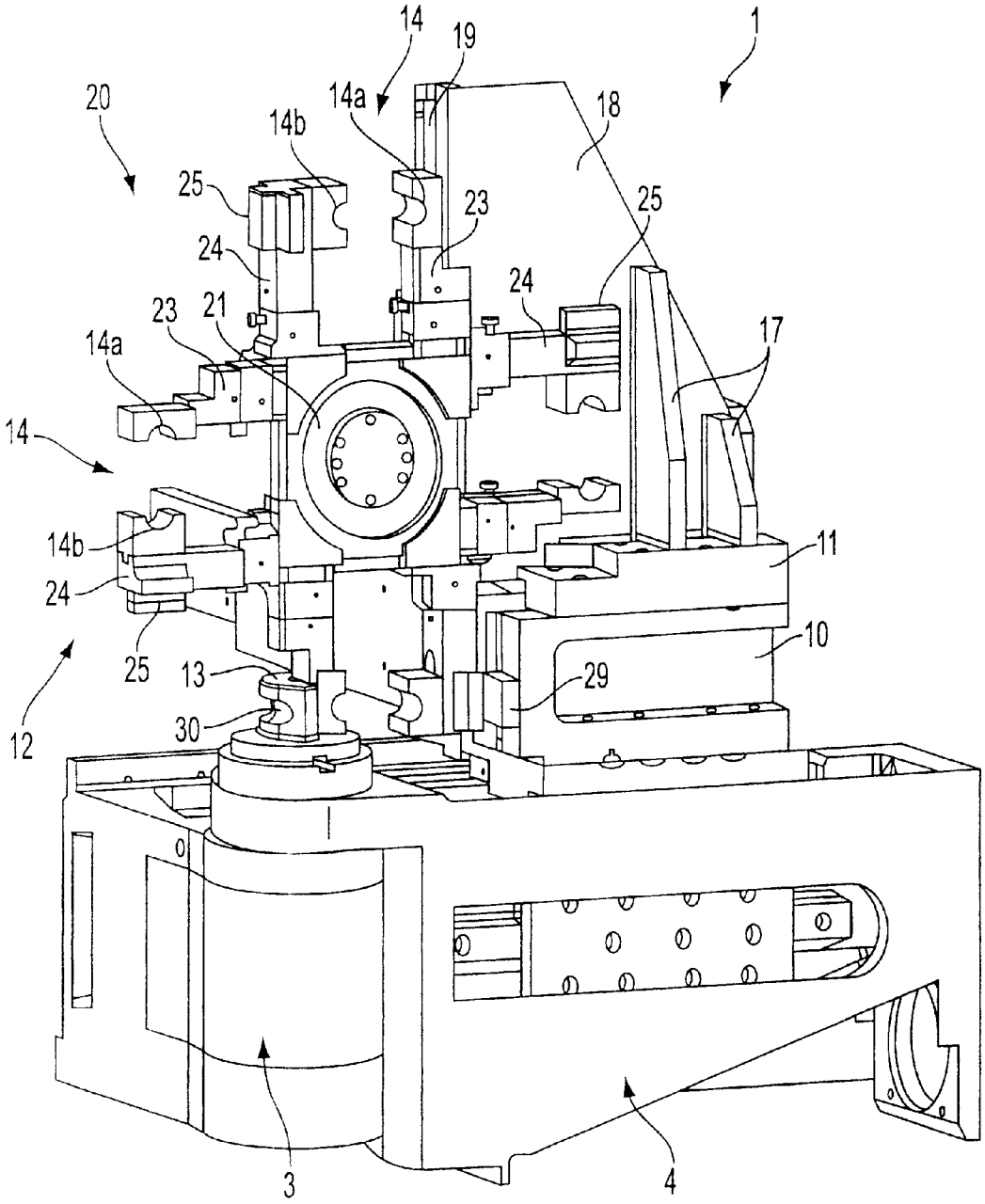
FIG. 2 is a view in perspective showing the bending head and the bending arm of the bending machine bearing the magazine device according to the invention.
Figure 3:
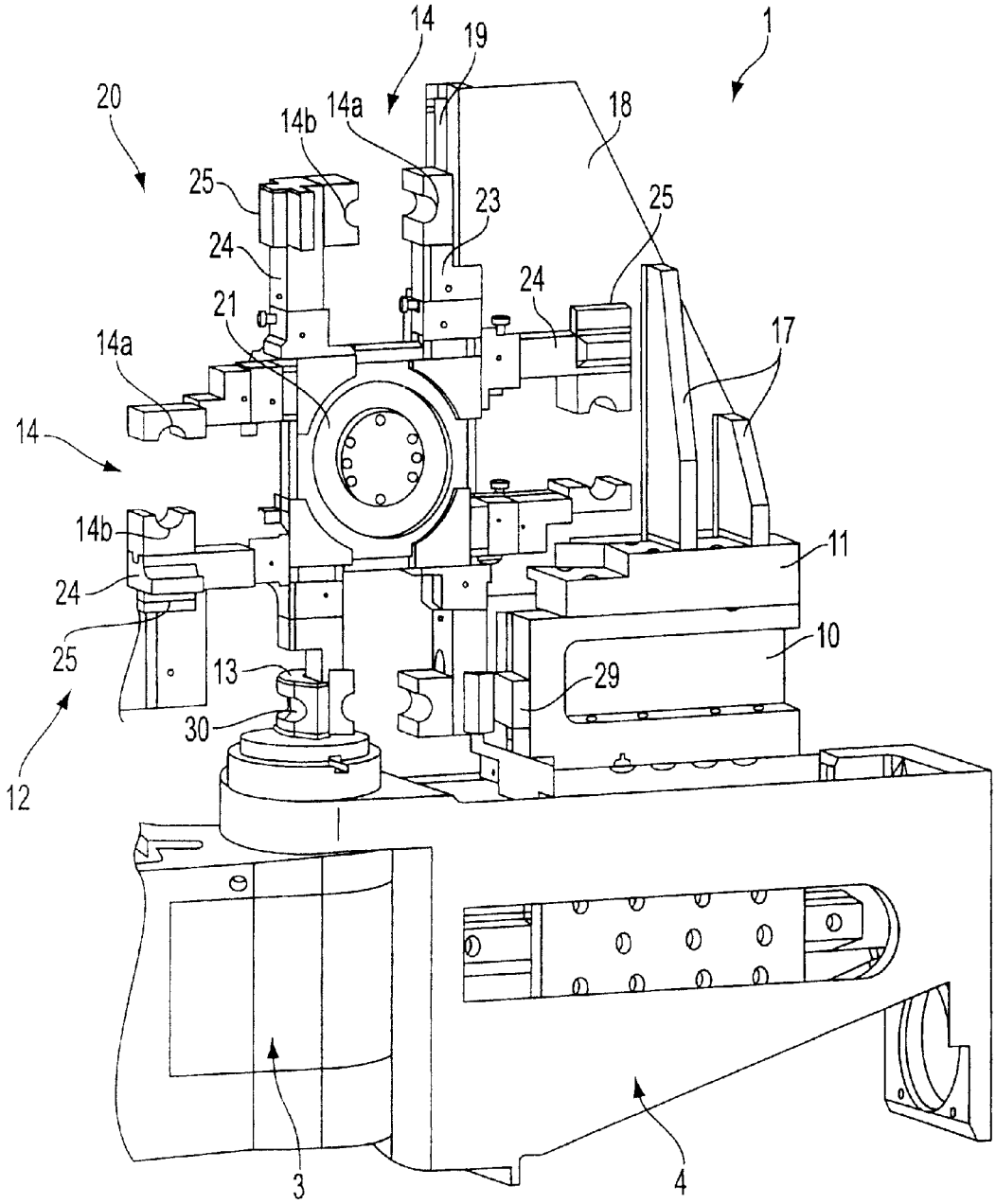
FIG. 3 is a view in perspective depicting the bending head about which the bending arm bearing the magazine device according to the invention has been pivoted.
Figure 4:
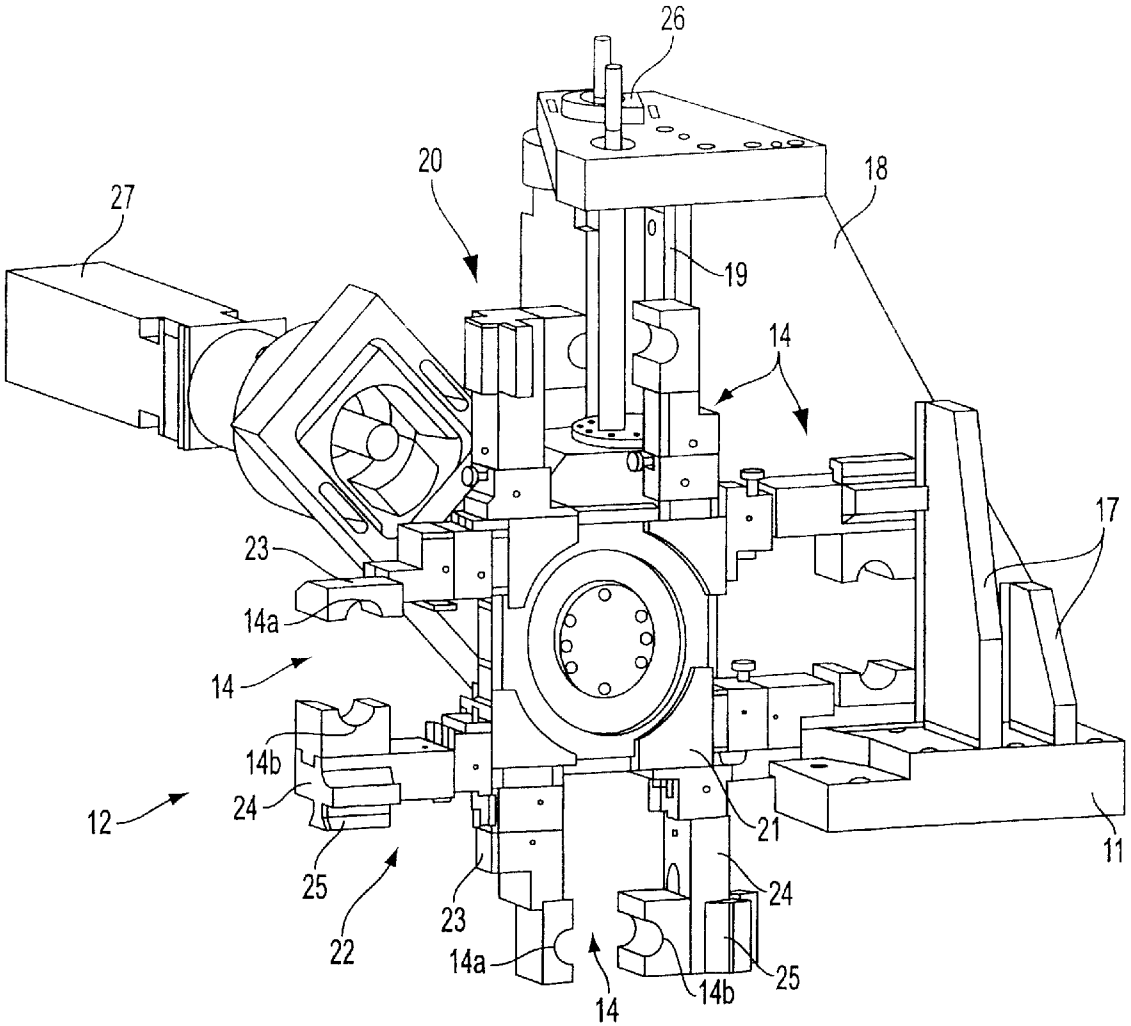
FIG. 4 is a view in perspective illustrating the magazine device and the pairs of clamping jaws.

FIGS. 2 to 4 depict the details of the end of the machine 1 comprising the bending head 3, the bending arm 4 and the magazine device 12.

The bending head 3 is secured to a bending roller 13 constituting a device for attaching one of the jaws of one pair 14 of clamping jaws as will be seen better later on. The bending roller 13 has a circular profile, part of which is cut away to form an L-shaped cutout 28. The roller 13 has a peripheral groove 30, the bend radius of which can vary according to the shape to be produced on the tube 8.

The bending head 3 comprises movement means, so that it can be moved horizontally with respect to the fixed frame 2, that is to say in a direction that is in a plane perpendicular to the plane containing the longitudinal axis of the machine 1 or of the fixed frame 2, which is generally embodied by the tube 8.

The jaw support 10 has, on its vertical edge 15 facing the bending head 3, a T-shaped slot 16. The slot 16 may be designed with some other profile so as to form a vertical slideway which is open at the top and horizontal edge of the jaw support 10.

The vertical plate 11 is secured to beams 17 extending vertically and to which a magazine holder 18 is welded. The latter is secured to a vertical rib 19 lying in a plane parallel to the plane containing the slot 16 in the jaw support 10, so as to allow a magazine 20 to be moved vertically.

The magazine 20 consists of a plate 21 of square profile, each peripheral edge of which comprises an attachment device 22 for fitting a pair 14 of clamping jaws.

At each corner of the plate 21 each attachment device 22 of the magazine 20 comprises a jaw 23 and 24 of a pair 14 of clamping jaws.

The jaws 23 and 24 of each pair 14 of clamping jaws have an impression 14*a*, 14*b* of a shape that complements the exterior profile of the tube 8 before it is bent. The impressions 14*a*, 14*b* have complementing profiles which may either be bent, or of different lengths, or of different orientations in space, so as to form pairs 14 of clamping jaws with different impressions on each peripheral edge of the magazine 20.

The jaws 23 and 24 of each pair 14 of clamping jaws are designed to move along the peripheral edge of the plate 21 toward the tube 8 held on the fixed frame 2 of the machine 1.

On its opposite face to the one which has the impression 14*b* of the pair 14 of clamping jaws, each jaw 24 has a rib 25 which is designed to collaborate with an intermediate element 29 which is housed in the slot 16 in the jaw support 10 of the bending arm 4 during vertical movements of the magazine 20.

The intermediate element 29 may be positioned beforehand either on the jaw 24 or on the jaw support 10, so as to allow the jaw to be indexed on the jaw support.

The other jaw 23 of each pair 14 of clamping jaws comprises, on the opposite side to its impression 14*a*, a profile 31 which complements the cutout 28 for attaching it to the bending roller 13.

The magazine 20 can be moved vertically along the magazine holder 18 and in a plane parallel to the plane containing the magazine holder by way of a motor 26 or any other electrical or hydraulic means.

The vertical movement of the magazine 20 allows the jaws 23 and 24 of the corresponding pair 14 of clamping jaws to be introduced in and/or removed from the bending roller 13 of the bending head 3 and the jaw support 10 of the bending arm 4.

The magazine 20 may also be rotated about its longitudinal axis using another motor 27 so as to bring the pair 14 of clamping jaws 14, which corresponds to the exterior profile of the tube 8 before it is bent, over the bending roller 13 of the bending head 3 and the jaw support 10 of the bending arm 4.

It can be seen from FIG. 3 that the magazine 20 of the magazine device 12, when the tube 8 is being bent, pivots about the vertical axis of the bending head 3 when the bending arm 4 is moved about the bending head.

FIGS. 5 to 10 show various stages of the movement of the magazine device 12 for producing a radius of curvature equivalent to that of the groove 30 of the bending roller 13 in the tube 8.

Figure 5:
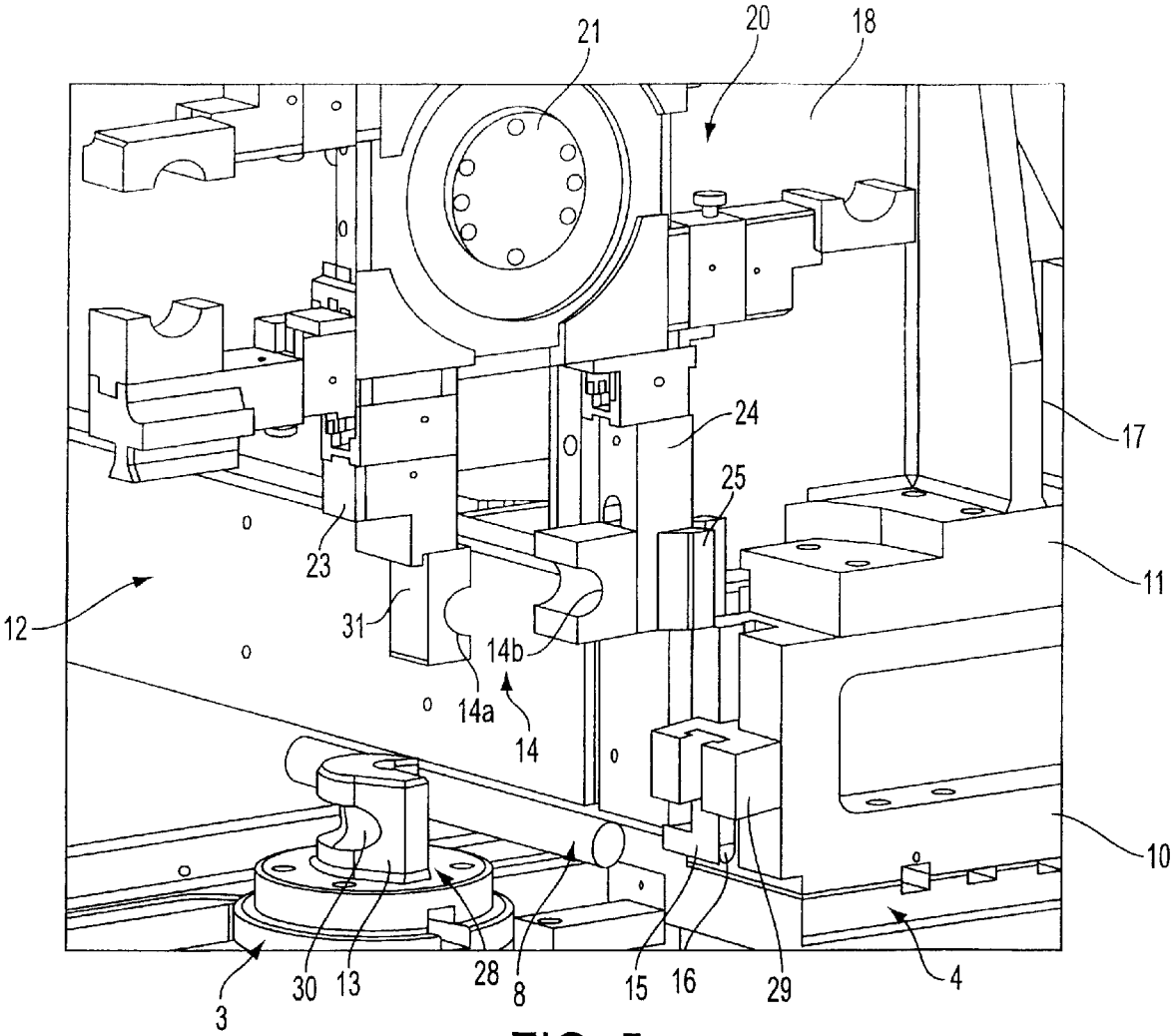
FIGS. 5 to 10 are part views showing the cycle of movement of the magazine device for bending a tube using the pairs of clamping jaws.

The magazine device 12 is placed in a raised position using the motor 26, so that the magazine 20 lies above the bending head 3 and the bending arm 4 (FIG. 5).

The magazine 20 is then rotated about its longitudinal axis using the motor 27, to determine the pair 14 of clamping jaws to be used according to the impression 14*a*, 14*b* that corresponds to the exterior profile of the tube 8 (FIG. 5).

Figure 6:
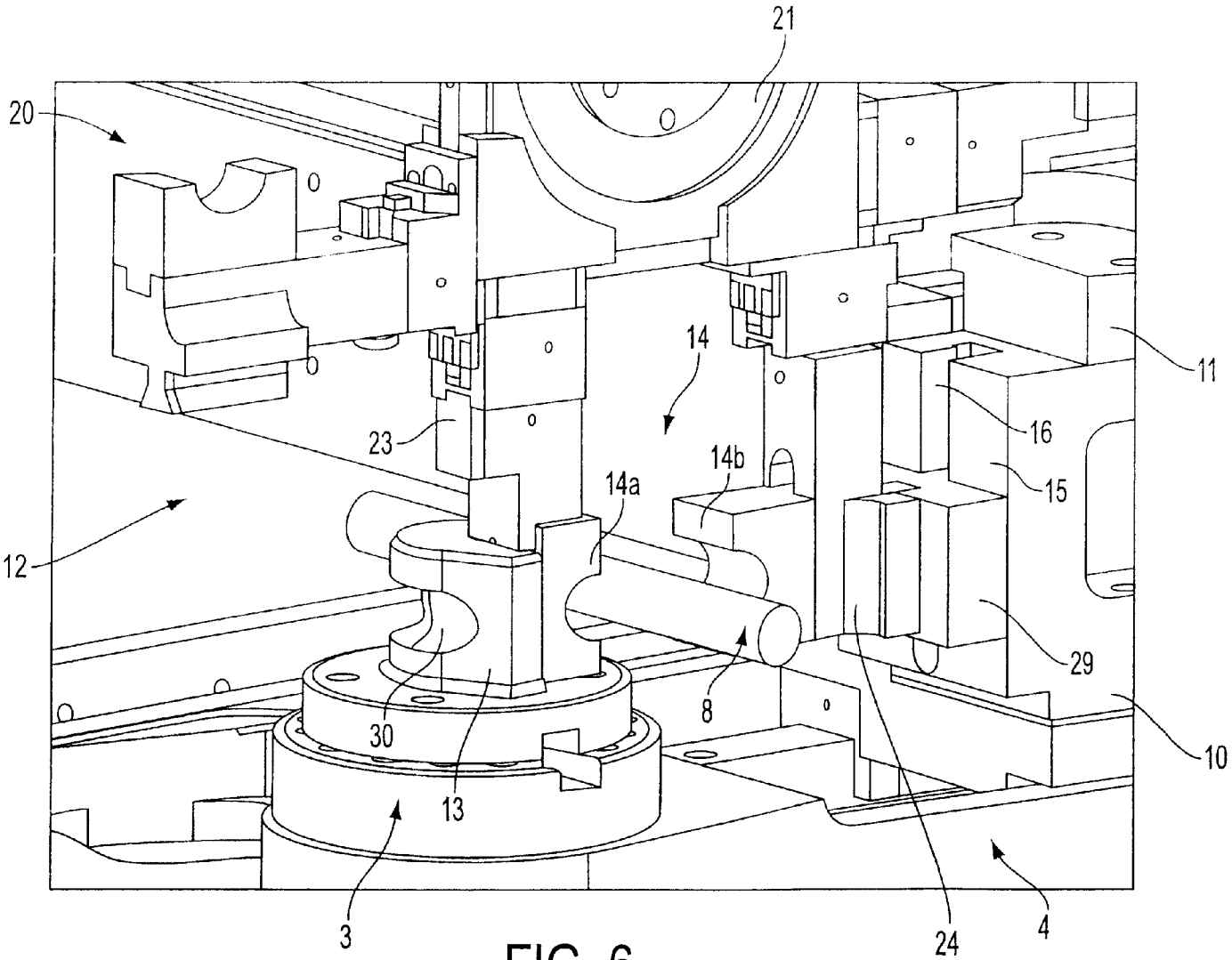

Next, the magazine device 12 is placed in a lowered position by motor 26, so that the jaws 23 and 24 of the corresponding pair 14 of clamping jaws are level with the tube 8 (FIG. 6).

The lowering of the magazine 20 allows simultaneous indexing of the jaw 23 on the bending roller 13 of the bending head 3 and of jaw 24 on the jaw support 10 of bending arm 4. The profile 31 of jaw 23 is positioned in the L-shaped cutout 28, while the intermediate element 29 of the jaw 24 collaborates with the slot 16 in the jaw support 10 (FIG. 6).

Figure 7:
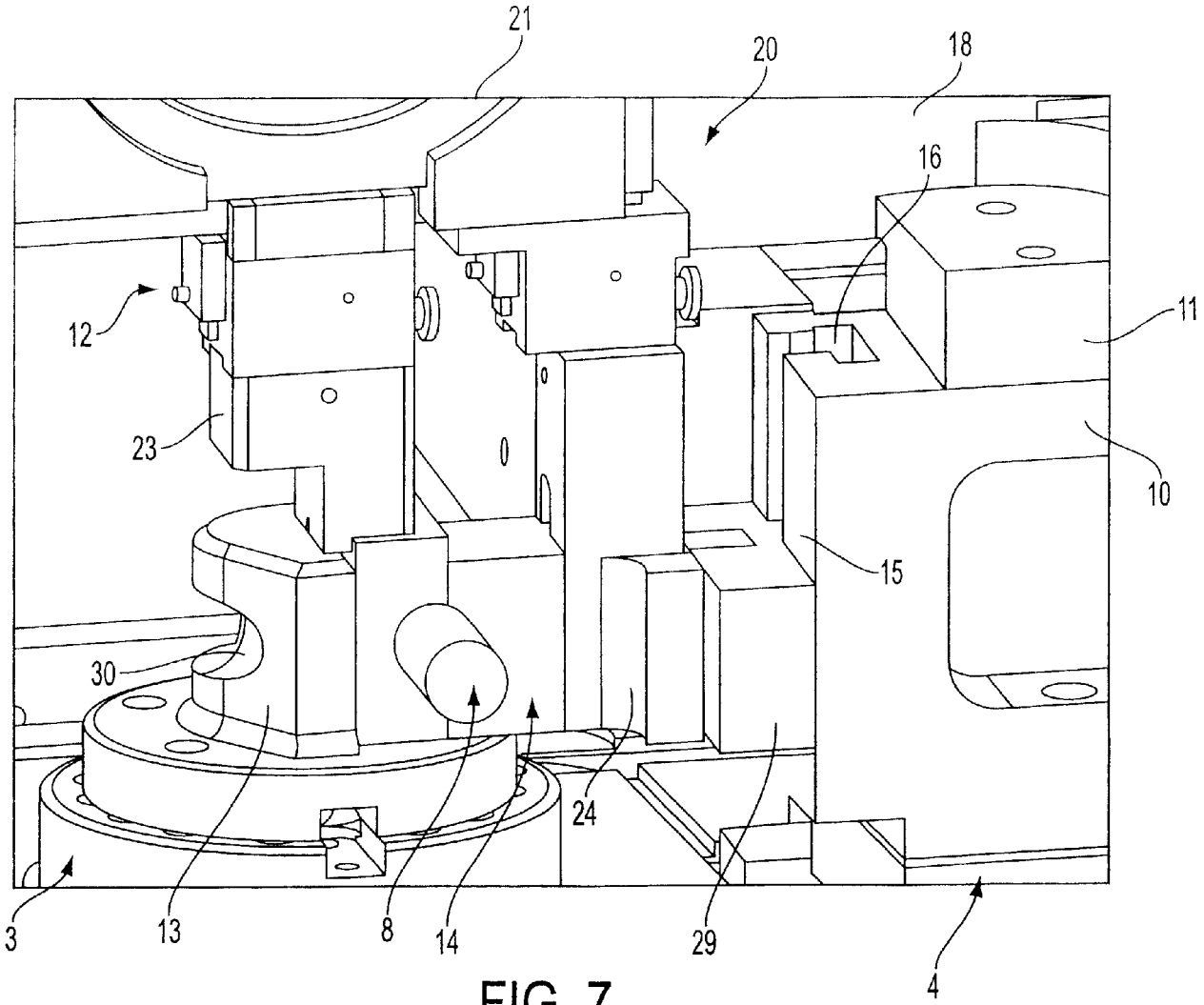

As soon as the jaws 23 and 24 of the pair 14 of clamping jaws are in abutment in their respective attachment means, the bending head 3 and the jaw support 10 are moved horizontally toward the tube 8 to bring impressions 14*a* and 14*b* of each jaw 23, 24 up against said tube 8 (FIG. 7).

Figure 8:
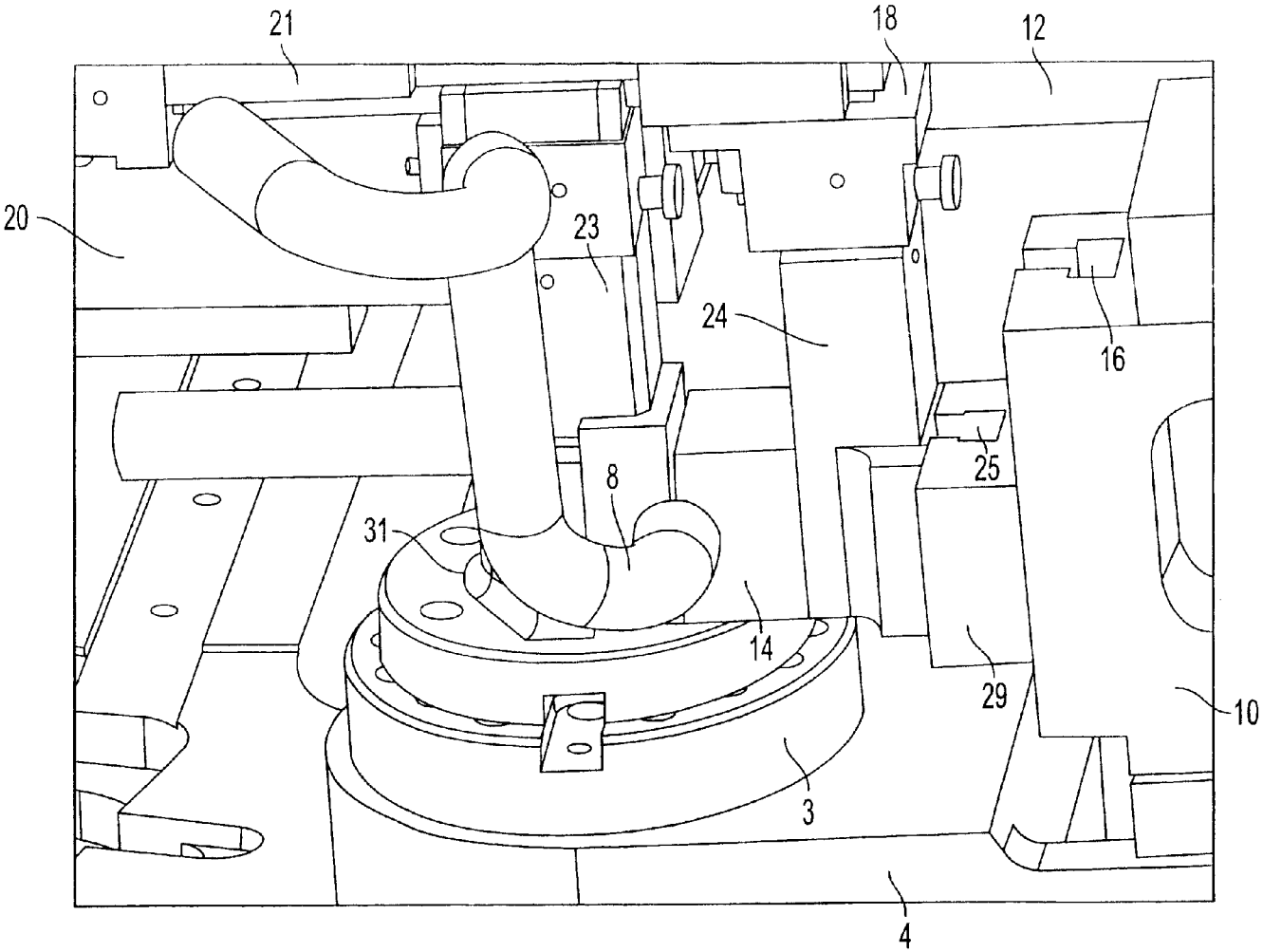

All that is then required, as well known in the art, is for the bending arm 4 to be pivoted about the vertical axis of the bending head 3 in order to shape the tube 8 to the radius of curvature of the groove 30 of the bending roller 13 (FIG. 8).

Figure 9:
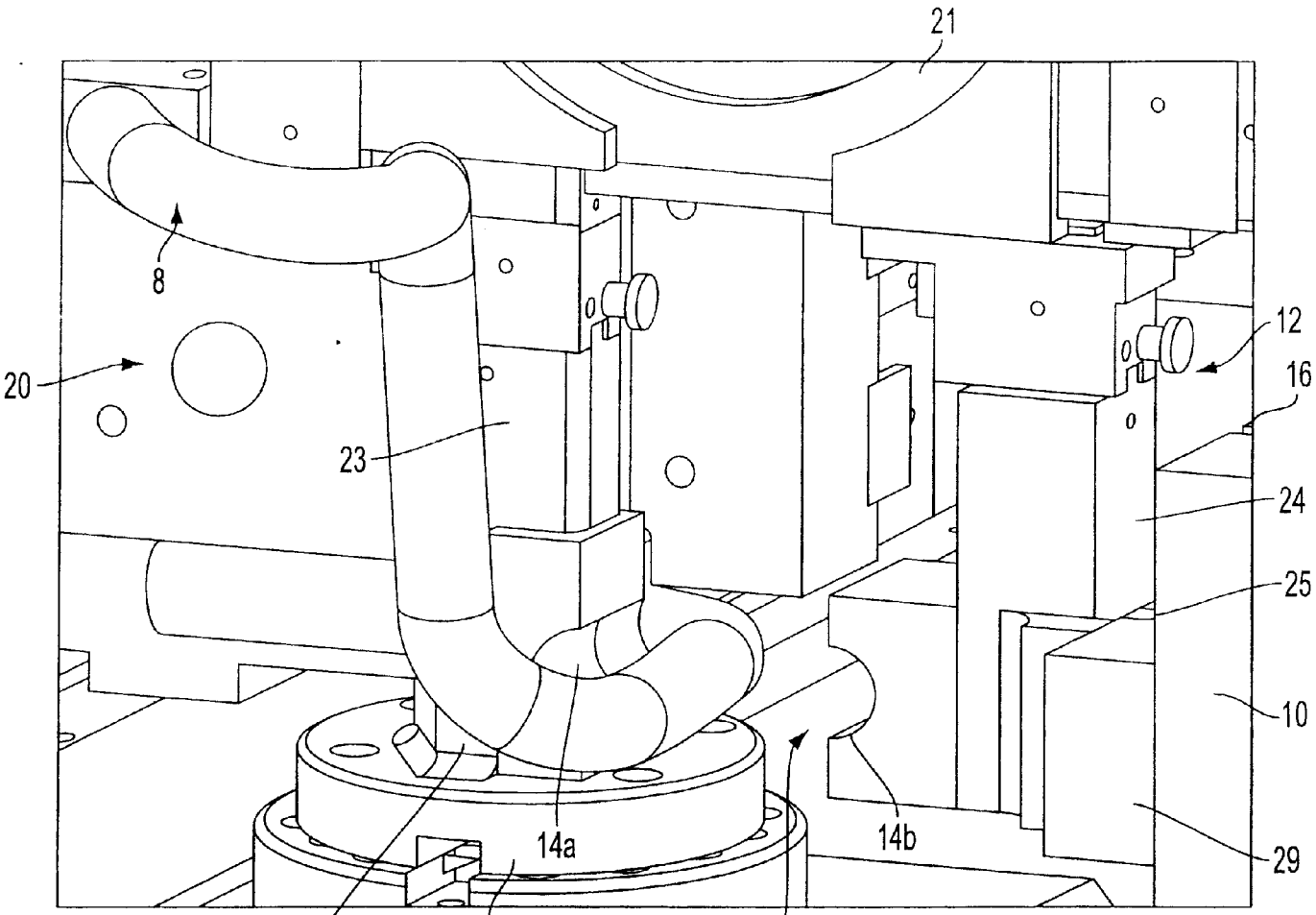

When the tube 8 has been bent, and before pivoting the bending arm 4 back in the opposite direction about the bending head 3, bending head, and the jaw support 10, return to their starting positions in a horizontal direction in order to move the jaws 23 and 24 apart so as to release the impressions 14*a* and 14*b* from the tube 8 (FIG. 9).

Figure 10:
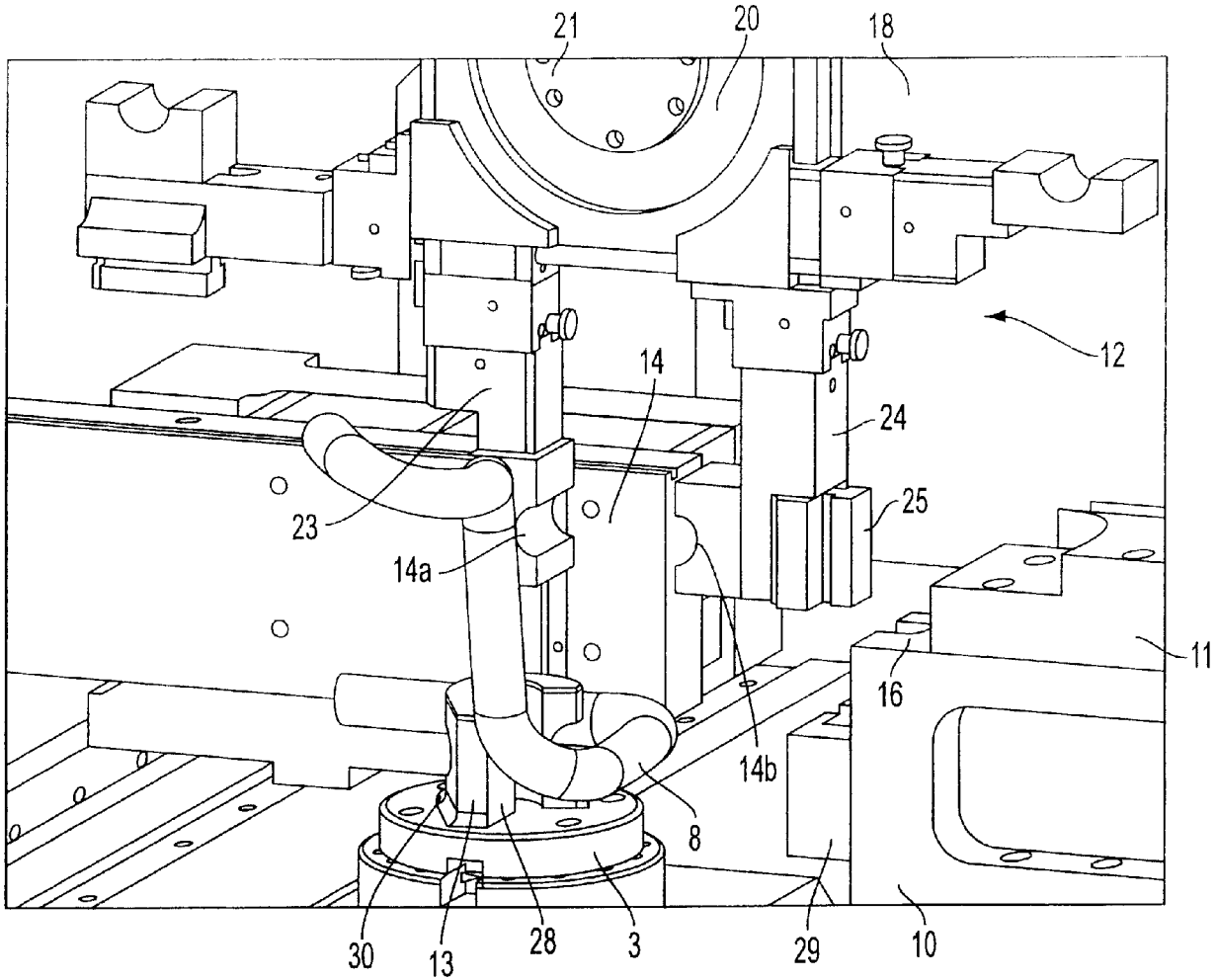

As soon as the jaws 23 and 24 have been separated horizontally from the tube 8, and before the bending arm 4 is pivoted about the bending head 3, the magazine 20 is raised again using the motor 26 to the raised position so as to disengage the jaws from the bending roller 13 and from the jaw support 10 (FIG. 10).

The bending arm 4 then pivots about the vertical axis of the bending head 3 to return to its starting position shown in FIG. 5, so that a new pair 14 of clamping jaws 14 can be selected and a further bending cycle as described hereinabove can be started.

The magazine device 12 can be moved both in terms of rotation about its longitudinal axis and in directions which lie in planes perpendicular and/or parallel to the plane containing the longitudinal axis of the fixed frame 2 which is embodied by the axis of the tube 8 that is to be bent.

What is claimed is:

1. Tube bending machine comprising an elongated fixed frame secured at one of its ends to a bending head and to a bending arm pivoting about said bending head, comprising:

a magazine device on the bending arm, said magazine device bearing pairs of cooperable clamping jaws with different impressions formed thereon, and being pivotable at the same time as the bending arm about the bending head so as to shape tubes, said magazine device being moveable both, rotationally about a longitudinal axis and in directions lying in planes which are at least one of, perpendicular and parallel to a plane containing a longitudinal axis of the elongated fixed frame.

2. Tube bending machine according to claim 1, wherein the magazine device comprises:

a magazine;

a jaw support sliding along the bending arm;

a magazine holder secured to the jaw support;

a first motor for moving said magazine vertically on the magazine holder;

a second motor for rotating said magazine about its own longitudinal axis;

said magazine comprising at least one of the pairs of cooperable clamping jaws being arranged on its periphery;

said cooperable clamping jaws comprising two opposed jaws, a first of said two opposed jaws cooperating with a bending roller of the bending head; and a second of said opposed jaws cooperating with the jaw support of the bending arm.

3. Tube bending machine according to claim 2, wherein the magazine comprises a plate, each peripheral edge of which comprises an attachment device which allows the corresponding pair of cooperable clamping jaws to slide.

4. Tube bending machine according to claim 3, wherein the plate is of square shape.

5. Tube bending machine according to claim 4, wherein each of the pairs of cooperable clamping jaws has an impression formed thereon, said impression complementing the exterior profile of the tube before it is bent.

6. Tube bending machine according to claim 2, wherein the jaw support comprises a slot on a vertical edge thereof, said slot cooperating with an intermediate element secured to one of the jaws of the corresponding pair of cooperable clamping jaws or to said jaw support.

7. Tube bending machine according to claim 1, wherein the bending head moves in a horizontal direction lying in a plane perpendicular to a plane containing a longitudinal axis of the fixed frame.

8. Magazine device of a tube bending machine including a fixed frame having a longitudinal axis and being secured at one of its ends to a bending head and to a bending arm pivoting about said bending head, comprising:

at least one pair of cooperable clamping jaws which have impressions formed thereon;

a first movement mechanism which, on the one hand, allows said magazine device to be pivoted about the bending head at the same time as the bending arm and, on the other hand, allows the magazine device to be moved in directions which lie in planes which are at least one of perpendicular and parallel to the plane containing the longitudinal axis of the fixed frame;

a second movement mechanism, which concurrently allows the magazine device to be rotated about a longitudinal axis.

9. Magazine device according to claim 8, further comprising:

a magazine holder secured to a jaw support sliding along the bending arm;

a magazine;

a first motor for moving said magazine in vertical translation on the magazine holder;

a second motor for rotating said magazine about the longitudinal axis of the magazine;

said magazine comprising on its periphery the at least one pair of cooperable clamping jaws;

said cooperable clamping jaws comprising two opposed jaws;

a first of said opposed jaws cooperating with a bending roller of the bending head; and a second of said opposed jaws cooperating with the jaw support of the bending arm.

10. Magazine device according to claim 9, wherein the magazine comprises a plate, each peripheral edge of which comprises an attachment device which allows the at least one pair of cooperable clamping jaws to slide.

11. Magazine device according to claim 10, wherein the plate is of a square shape.

12. Magazine device according to claim 9, wherein the jaws of the at least one pair of cooperable clamping jaws have an impression formed thereon which complements the exterior profile of a tube before the tube is bent.

13. Magazine device according to claim 9, wherein the jaw support comprises, on a vertical edge, a slot which cooperates with an intermediate element secured to one of the jaws of the at least one pair of cooperable clamping jaws.

14. Magazine device according to claim 9, wherein the jaw support comprises, on a vertical edge, a slot which cooperates with an intermediate element secured to said jaw support.

15. Method for loading a pair of clamping jaws in order to operate a tube bending machine which comprises a fixed frame secured at one of its ends to a bending head and a bending arm pivoting about said bending head, comprising:

positioning a magazine device in a raised position on a magazine holder using a first motor;

rotating a magazine about an axis using a second motor in order to select a pair of clamping jaws according to an impression formed on the jaws which corresponds to an exterior profile of a tube before the tube is bent;

lowering the magazine so that the clamping jaws index simultaneously and respectively, one of the clamping jaws on a bending roller of the bending head, and another of the clamping jaws, a jaw support of the bending arm;

moving the bending head and the jaw support horizontally toward the tube so as to bring the clamping jaws of a corresponding pair of clamping jaws up against said tube; and bending the tube by pivoting the bending arm and the magazine device about the bending head and the bending roller.

16. Method for loading a pair of clamping jaws in order to operate a tube bending machine, the tube bending machine including an elongated fixed frame secured at one of its ends to a bending head and to a bending arm pivoting about said bending head, a magazine device on the bending arm, said magazine device bearing pairs of clamping jaws with at least two of the pairs having different impressions formed thereon, and being pivotable at the same time as the bending arm about the bending head so as to shape tubes, said magazine device being moveable both, rotationally about an axis and in directions lying in planes which are at least one of, perpendicular and parallel to a plane containing the longitudinal axis of the elongated fixed frame, the magazine device including a magazine, a jaw support sliding along the bending arm, a magazine holder secured to the jaw support, a first motor for moving said magazine vertically on the magazine holder, a second motor for rotating said magazine about its own longitudinal axis, said magazine including at least one pair of clamping jaws on its periphery, said clamping jaws comprising two opposed jaws, a first of said two opposed jaws cooperating with a bending roller of the bending head, and a second of said opposed jaws cooperating with the jaw support of the bending arm, the method comprising:

positioning said magazine device in a raised position on the magazine holder using said first motor;

rotating the magazine about the axis using the second motor in order to select the pair of clamping jaws according to the impression formed on the jaws which corresponds to the exterior profile of the tube before the tube is bent;

lowering the magazine device so that the clamping jaws of the corresponding pair of clamping jaws index simultaneously and respectively, one of the clamping jaws on a bending roller of the bending head, and another of the clamping jaws, a jaw support of the bending arm;

moving the bending head and the jaw support horizontally toward the tube so as to bring the clamping jaws of a corresponding pair of clamping jaws up against said tube; and bending the tube by pivoting the bending arm and the magazine device about the bending head and the bending roller.

17. Tube bending machine comprising an elongated fixed frame secured at one of its ends to a bending head and to a bending arm pivoting about said bending head, comprising:

a magazine device on the bending arm, said magazine device bearing pairs of clamping jaws with at least two of the pairs having different impressions formed thereon, and being pivotable at the same time as the bending arm about the bending head so as to shape tubes, said magazine device being moveable both, rotationally about an axis and in directions lying in planes which are at least one of, perpendicular and parallel to a plane containing the longitudinal axis of the fixed frame, said magazine device including a magazine, a jaw support sliding along the bending arm, a magazine holder secured to the jaw support, a first motor for moving said magazine vertically on the magazine holder, a second motor for rotating said magazine about the axis, the magazine comprising at least one pair of clamping jaws on its periphery, the clamping jaws comprising two opposed jaws, a first of said two opposed jaws cooperating with a bending roller of the bending head, and a second of said opposed jaws cooperating with the jaw support of the bending arm, the jaw support comprising a slot on a vertical edge thereof, said slot cooperating with an intermediate element secured to one of the jaws of the corresponding pair of clamping jaws or to said jaw support, the bending head moving in a horizontal direction lying in a plane perpendicular to a plane containing a longitudinal axis of the fixed frame.

* * * * *